US005377836A

United States Patent [19]

Eisenbraun

[11] Patent Number: 5,377,836

[45] Date of Patent: Jan. 3, 1995

[54] BLISTER CARD DISPLAY PACKAGE

[75] Inventor: Kenneth D. Eisenbraun, Birmingham, Mich.

[73] Assignee: United Industrial Trading Corporation, Troy, Mich.

[21] Appl. No.: 130,702

[22] Filed: Oct. 4, 1993

[51] Int. Cl.[6] ..... B65D 73/00

[52] U.S. Cl. ..... 206/461; 206/464; 206/467; 206/470

[58] Field of Search ..... 206/232, 461, 462, 464, 206/465, 467, 470; 229/92.8

[56] References Cited

U.S. PATENT DOCUMENTS

| | | | |
|---|---|---|---|
| 2,884,127 | 4/1959 | Neary | 206/462 |
| 3,289,830 | 12/1966 | Foote | 206/462 |
| 3,358,824 | 12/1967 | Stagnitto | 206/461 |
| 3,502,486 | 3/1970 | Lundquist | 99/171 |
| 3,519,128 | 7/1970 | Swanberg | 206/461 |
| 3,685,649 | 8/1972 | Diehl | 206/462 |
| 4,200,193 | 4/1980 | Boyle | 206/461 |
| 4,236,636 | 12/1980 | Kuchenbecker | 206/461 |
| 4,266,666 | 5/1981 | Kuchenbecker | 206/461 |
| 4,300,682 | 11/1981 | Kuchenbecker | 206/461 |
| 4,574,951 | 3/1986 | Weaver | 206/470 |
| 4,779,734 | 10/1988 | Kydonieus | 206/470 |
| 4,840,275 | 6/1989 | Fiaola et al. | 206/462 |
| 4,951,404 | 8/1990 | Lithwick | 206/462 |
| 4,997,153 | 3/1991 | Feibelman | 248/214 |
| 5,154,293 | 10/1992 | Gould | 206/461 |

*Primary Examiner*—David T. Fidei
*Attorney, Agent, or Firm*—Krass & Young

[57] ABSTRACT

A blister card display package including a display card and a blister pack mounted on the card and including a blister portion for containing an article to be displayed. The card is folded in half to define identical front and rear portions having free edges which are aligned with the card in its folded configuration and the blister pack is mounted on the front face of the front portion of the card and includes a tab portion adapted to fit over the aligned free edges of the folded card. The tab portion releasably maintains the card in its folded configuration but readily allows the card, following removal from a display peg, to be moved to its open position to allow the potential purchaser to examine the descriptive and advertising material contained on the outer and inner surfaces of the front and rear portions of the card.

9 Claims, 3 Drawing Sheets

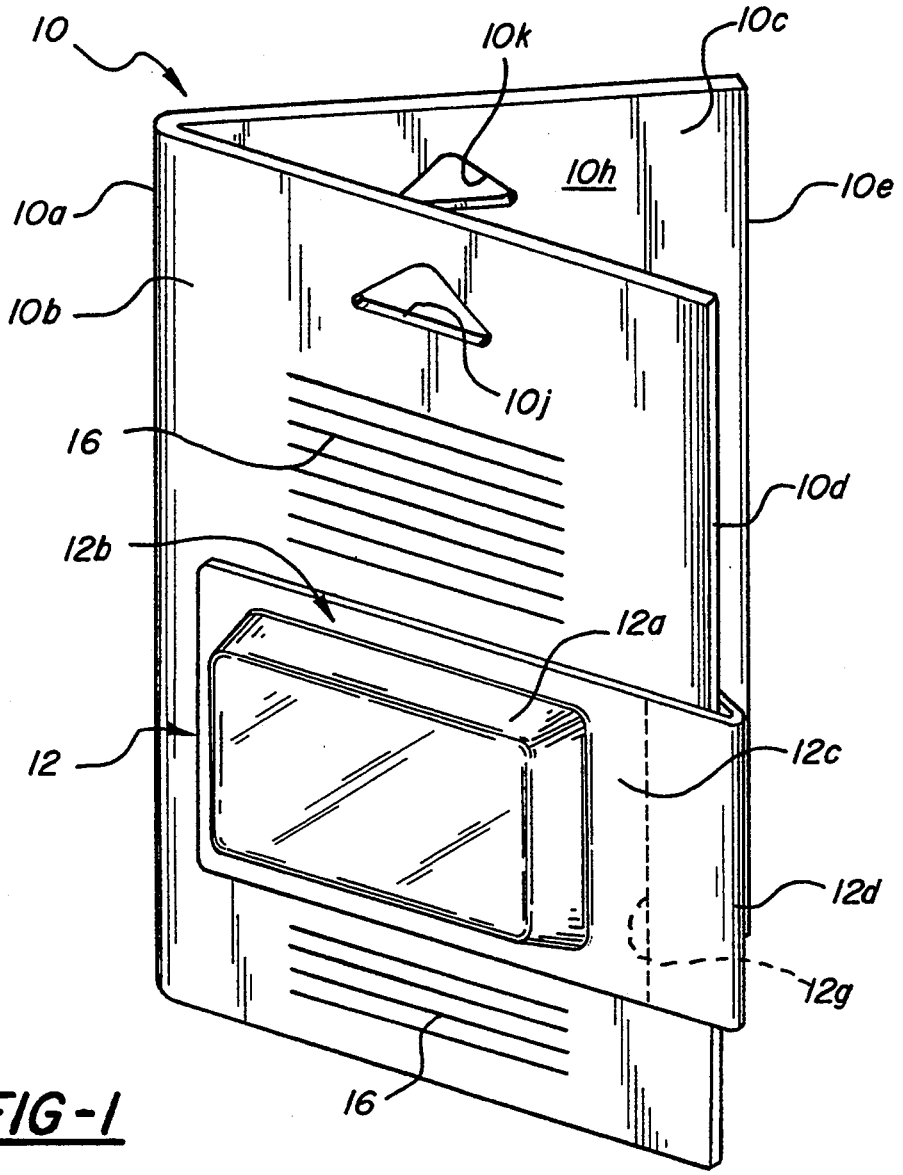
FIG-1
FIG-2
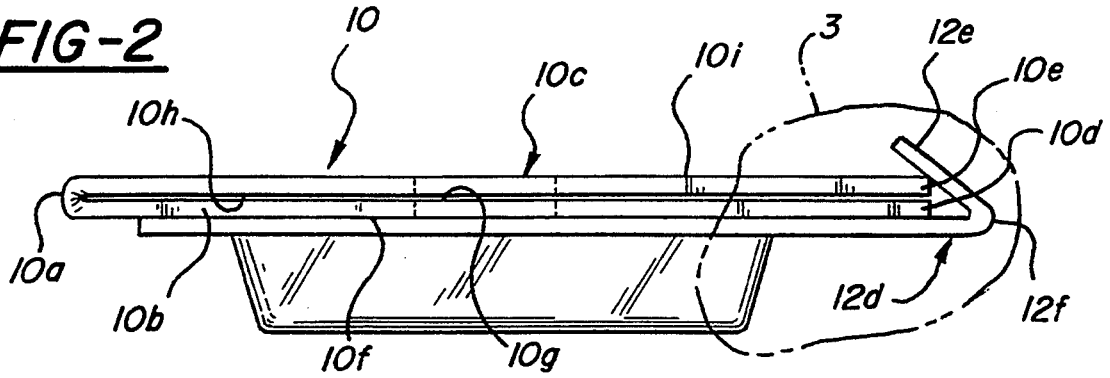

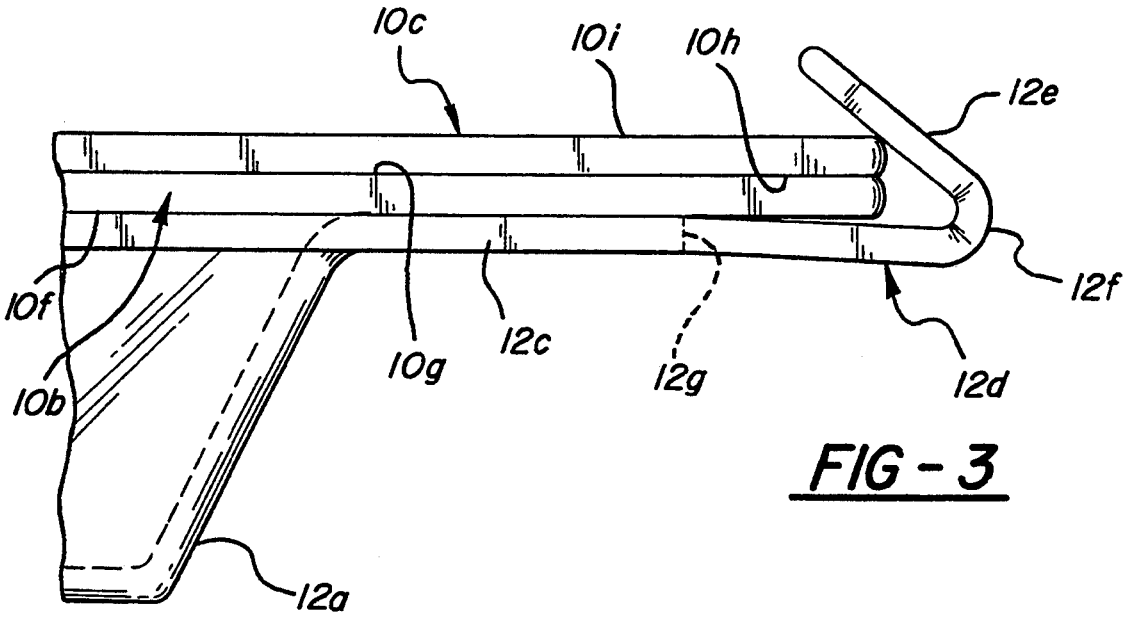
FIG-3
FIG-4
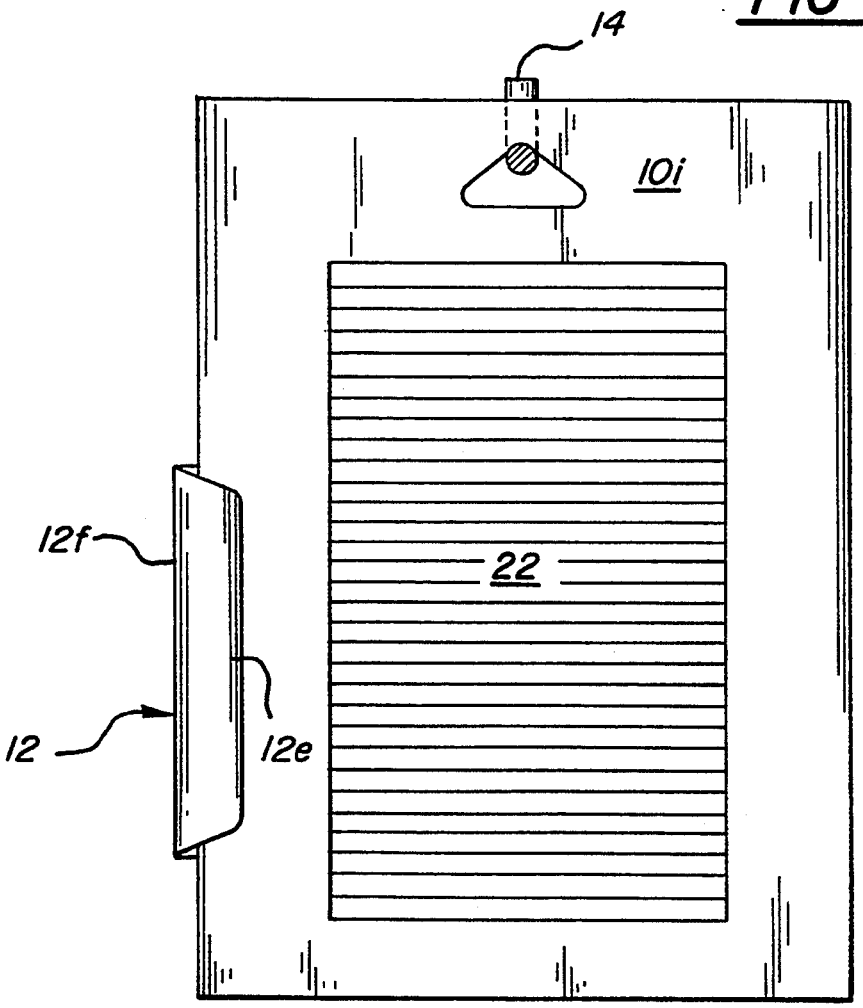

BLISTER CARD DISPLAY PACKAGE

BACKGROUND OF THE INVENTION

This invention relates to display packages comprising a paper board card and a plastic blister pack secured to the card and containing an article to be displayed.

Blister card display packages are commonly used in retail merchandising in a pegboard display arrangement. Typically the packages include a paperboard card on which product or advertising information is printed and a plastic blister pack secured to the face of the card and forming a container in which products are displayed and held. A hole is typically formed at the top of the card so that the package can be held on an extended peg of a pegboard display. In this manner large volumes of varied items can be held on a pegboard with a plurality of packages positioned in stacked relation on each peg.

Whereas these prior art blister packages have been generally satisfactory, they are limited in the sense that the amount of space available on the display card for advertising and descriptive material is limited to the space on the display card not occupied by the blister pack.

SUMMARY OF THE INVENTION

This invention is directed to the provision of an improved blister card display package.

More specifically, this invention is directed to the provision of a blister card display package offering increased space for advertising and descriptive material.

The blister card display package of the invention is of the type including a display card and a blister pack mounted on the card and including a blister portion for containing an article to be displayed. According to the invention, the card is folded essentially in half to define substantially identical front and rear portions having free edges which are substantially aligned with the card in a folded configuration, the blister pack is mounted on the front face of the front portion of the display card, and the blister pack includes a locking portion operative to releasably maintain the card in its folded configuration. With this arrangement, the blister pack serves to maintain the package in its folded configuration for pegboard display purposes but allows a potential purchaser to readily open the folded card to examine the advertising and descriptive material on the inner and outer faces of the front and rear card portions.

According to a further feature of the invention, the locking portion comprises a tab portion positioned along the free edge of the front card portion and configured to be positioned over the free edge of the rear card portion to releasably maintain the card in its folded configuration.

According to a further feature of the invention, the blister pack includes an annular planar base portion secured to the front face of the front card portion in surrounding relation to the blister portion and including a side section proximate the free edge of the front portion, and the tab portion forms a lateral extension of the side section of the base portion. This specific blister pack construction facilitates the ready and inexpensive provision of the locking tab.

According to a further feature of the invention, the card includes means for hanging the package from a support device with the card fold line and the aligned free edges vertically disposed. This arrangement facilitates effective display of the package from a pegboard.

In the disclosed embodiment of the invention, the hanging means comprises apertures in the front and rear card portions which are aligned with the card in its folded configuration and the tab portion has a hook configuration and is configured to be hooked over the free edges of the front and rear portions of the folded card.

BRIEF DESCRIPTION OF THE DRAWINGS

FIG. 1 is a perspective view of a blister card display package according to the invention;

FIG. 2 is a top view of the invention blister card display package;

FIG. 3 is a detail view taken within the circle 3 of FIG. 2;

FIG. 4 is a rear view of the invention blister card display package;

DETAILED DESCRIPTION OF THE PREFERRED EMBODIMENT

The invention blister card display package, broadly considered, includes a display card 10 and a blister package 12.

Figure 5:
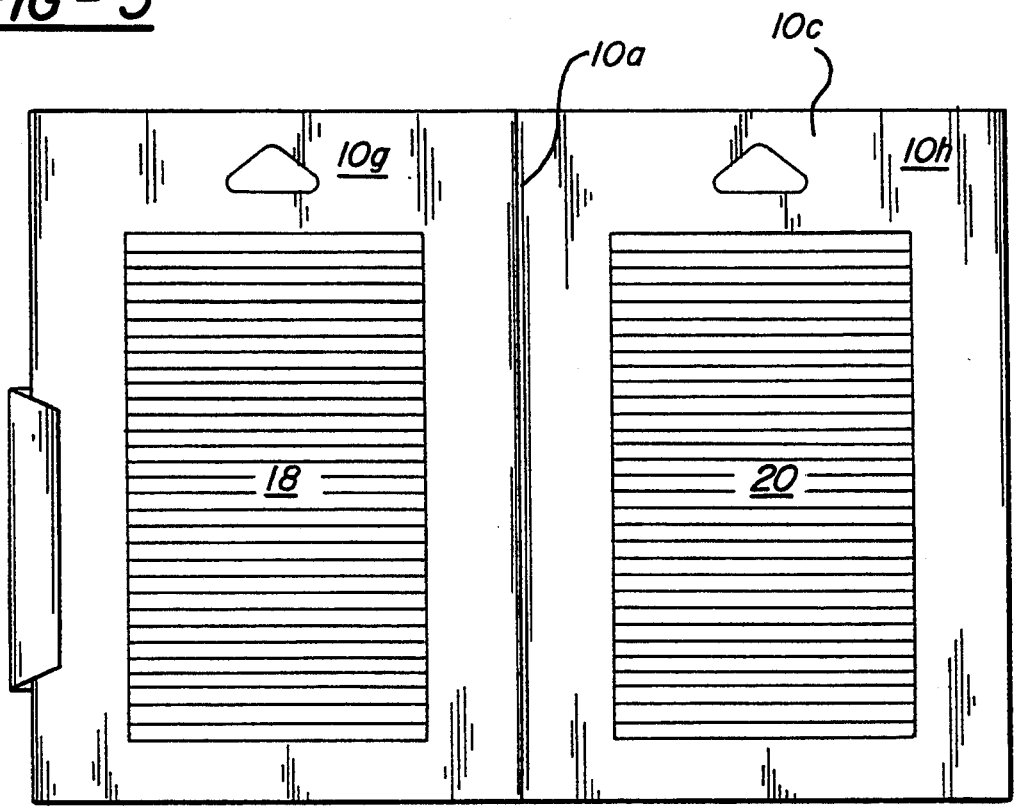
FIG. 5 is a view of the invention blister card display package showing the package in an unfolded configuration.
Figure 6:
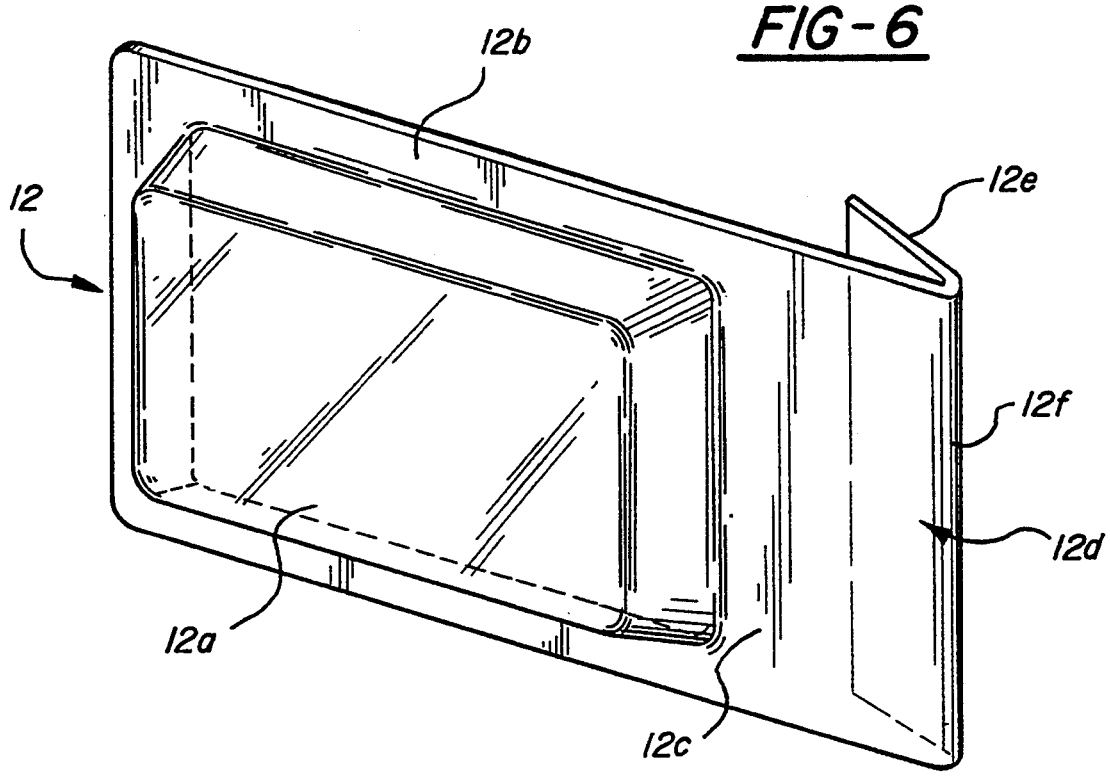
FIG. 6 is a perspective view of a blister pack forming a part of the invention blister card display package.

Display card 10 is formed of a suitable paperboard product and has a generally rectangular configuration. Display card 10 is folded in half about a vertical crease line 10*a* to form a folder having substantially identical front and rear rectangular card sheet portions 10*b* and 10*c*. Display card 10 thus has an open configuration as seen in FIG. 5 in which front and rear sheets or portions 10*b* and 10*c* are substantially planar and a folded configuration, as seen in FIGS. 2 and 3, in which front and rear portions 10*b* and 10*c* are totally folded upon each other so that the free vertical edge 10*d* of front portion 10*b* and the free vertical edge 10*e* of rear portion 10*c* are substantially aligned.

Front portion 10*b* defines a front or outer face 10*f* and a rear or inner face 10*g* and rear portion 10*c* defines an inner face 10*h* and an outer face 10*i*. Triangular apertures 10*j* and 10*k* are formed respectively in front and rear portions 10*b* and 10*c*. Apertures 10*j* and 10*k* are aligned with the card in its folded configuration to facilitate hanging of the card over a suitable peg 14 for display purposes.

Blister pack 12 is formed of a suitable clear plastic material and includes a raised blister portion 12*a* containing an article or product to be displayed, an annular planar base portion 12*b* in surrounding relation to blister portion 12*a* and including a side section 12*c*, and a locking tab portion 12*d* forming a lateral extension of side section 12*c*. Tab portion 12*d* has a hook configuration in cross section including a hook portion 12*e* angled with respect to the base portion 12*b* and connected to the main body section of tab portion 12*d* by a corner 12*f*.

Blister pack 12 is secured to the front face 10*f* of front card portion 10*b* utilizing adhesive and/or heat sealing in known manner with annular base portion 12*b* secured to the front face of the card; blister portion 12*a* extending outwardly from the front face of the card to accommodate the article to be displayed; side section 12*c* of base portion 12*b* positioned proximate the free edge 10*d* of the front card portion 10*b*; and locking tab portion 12*d* extending laterally from side section 12*c* to position tab corner portion 12*f* immediately laterally beyond the side edge 10*d* of front card portion 10*b* with hook portion 12*e* extending rearwardly and behind the card portion.

Hook portion 12*e* functions, as best seen in FIGS. 2 and 3, to releasably maintain the rear card portion 10*c* in a folded configuration with respect to front portion 10*b*. Tab portion 12*d* is not secured to the front face 10*f* of card portion 10*b* but rather is free to flex outwardly with respect to the card portion to facilitate outward flexing movement of the tab portion (generally about the dash line 12*g*) to allow the card to be moved to its open configuration and inward flexing movement of the tab portion to secure and maintain the card in its folded configuration.

The invention blister card display package is displayed on a peg 14 in its folded configuration with the peg 14 passing through aligned apertures 10*j* and 10*k* and with the hook portion 12*e* of the tab 12*d* maintaining the card in its folded configuration for display purposes. When a potential purchaser desires to examine the display package for the purpose of making a purchase decision with respect to the product displayed within the blister portion 12*a*, the package is removed from the hook 14 and the card is moved to its open configuration with the movement of the card to its open configuration being facilitated by flexing of the hook portion 12*e* of the tab 12*d* and/or flexing of the paperboard material of the card portion 10*c*. With the card in its open or unfolded configuration, the potential purchaser is now able to examine large quantities of descriptive and advertising material relating to the product. Specifically, in addition to the usual spaces 16 on the front face 10*f* of the front card portion 10*b* above and below the blister pack, the potential purchaser is now able to examine advertising and descriptive material 18 on the inner face 10*g* of front card portion 10*b*; further material 20 on the inner face 10*h* of the rear card portion 10*c*; and further material 22 on the outer face 10*i* of the rear card portion. Once the potential purchaser has finished examining all of the advertising and descriptive material on all of tile faces 16, 18, 20 and 22, the card may be returned to its folded configuration by inserting the rear card portion 10*c* under the hook portion 12*e* of the tab to allow the package to reassume its folded configuration, whereafter the card may either be replaced on the peg 14, or in the case of a positive purchase decision, carried in folded configuration by the purchaser to a checkout area of the store.

The invention will be seen to provide an improved blister card display package in which greatly increased areas are provided on the package for advertising and descriptive material relating to the displayed product and in which means are provided to conveniently maintain the package in a folded configuration for display purposes while readily allowing movement of the package to an open configuration to allow a potential purchaser to examine the advertising and descriptive material.

Whereas a preferred embodiment of the invention has been illustrated and described in detail, it will be apparent that various changes may be made in the disclosed embodiment without departing from the scope or spirit of the invention.

I claim:

1. A blister card display package comprising:

a card folded to form a folder having a front sheet, including a front face and a free edge, and a rear sheet having a free edge generally aligned with the free edge of the front sheet with the folder in a folded configuration; and a unitary blister pack formed of a clear plastic material mounted on the front face of the front sheet and including a blister portion for containing an article to be displayed and an integral locking portion operative to releasably maintain the folder in a folded configuration, the locking portion comprising a tab portion positioned along the free edge of the front sheet and having a hook configuration to enable the tab portion to be positioned over the free edge of the rear sheet to releasably maintain the folder in a folded configuration.

2. A package according to claim 1 wherein:

the tab portion is configured to be hooked over the free edges of the front and rear sheets.

3. A blister card display package comprising a blister card and a blister pack mounted on the card and including a blister portion for containing an article to be displayed, characterized in that:

the card is folded essentially in half to define substantially identical front and rear portions having free edges which are substantially aligned with the card in a folded configuration;

the blister pack is unitary, is formed of a clear plastic material, and is mounted on the front face of the front portion; and the blister pack includes locking means formed as an integral portion of the unitary blister pack and operative to releasably maintain the card in its folded configuration.

4. A blister card display package according to claim 3 wherein:

the locking means comprises a tab portion of the blister pack adapted to fit over the aligned free edges of the card to releasably maintain the card in its folded configuration.

5. A pack according to claim 4 wherein:

the tab portio has a hook configuration to enable the tab portion to be hooked over the free edges.

6. A pack according to claim 5 wherein:

the blister pack includes an annular planar base portion secured to the front face of the front card portion in surrounding relation to the blister portion and including a side section proximate the free edge of the front portion; and the tab portion forms a lateral extension of the side section of the base portion.

7. A pack according to claim 3 wherein:

the card includes means for hanging the package from a support device with the card fold line and the aligned free edges vertically disposed.

8. A pack according to claim 7 wherein:

the hanging means comprises apertures in the front and rear card portions which are aligned with the card in its folded configuration.

9. A blister card display package comprising:

a card folded to form a folder having a front sheet, including a front face and a free edge, and a rear sheet having a free edge generally aligned with the free edge of the front sheet with the folder in a folded configuration; and a blister pack mounted on the front face of the front sheet and including a blister portion for containing an article to be displayed and a locking portion operative to releasably maintain the folder in a folded configuration, the locking portion comprising a tab portion having a hook configuration to enable the tab portion to be hooked over the free edges of the front and rear sheets, the blister pack including an annular planar base portion secured to the front face of the front sheet in surrounding relation to the blister portion and including a side section proximate the free edge of the front sheet, the tab portion forming a lateral extension of the side section of the base portion.

* * * * *